US005373797A

United States Patent [19]

Bottoms et al.

[11] Patent Number: 5,373,797

[45] Date of Patent: Dec. 20, 1994

[54] HEM FORMER

[75] Inventors: Joseph A. Bottoms; Joseph C. Bottoms; Ronald C. Lovejoy, all of Barnesville, Ga.

[73] Assignee: Bottoms Associates, Inc., Barnesville, Ga.

[21] Appl. No.: 962,917

[22] Filed: Oct. 19, 1992

[51] Int. Cl.[5] ..... D05B 1/00

[52] U.S. Cl. ..... 112/262.3; 112/141

[58] Field of Search ..... 112/141, 142, 143, 260, 112/DIG. 2, DIG. 3, 147, 262.3, 136

[56] References Cited

U.S. PATENT DOCUMENTS

| | | | |
|---|---|---|---|
| 2,419,068 | 4/1947 | Gensheimer | 112/141 |
| 3,326,155 | 6/1967 | Paoficelli | 112/141 |
| 3,595,187 | 7/1991 | Gray | 112/141 |
| 3,631,826 | 1/1972 | Morgan | 112/141 |
| 3,776,156 | 12/1973 | Morgon | 112/141 |
| 4,186,674 | 2/1990 | Conner, Jr. | 112/153 |
| 4,287,841 | 9/1981 | Rooin | 112/141 X |
| 4,590,876 | 5/1986 | Mencke et al. | 112/262.3 |
| 4,655,150 | 4/1987 | Romano | 112/153 |
| 4,947,771 | 8/1990 | Miyachi et al. | 112/141 |
| 5,033,399 | 7/1991 | Miyachi et al. | 112/142 |
| 5,197,400 | 3/1993 | Prais | 112/147 |

FOREIGN PATENT DOCUMENTS

| | | | |
|---|---|---|---|
| 2839399 | 3/1980 | Germany | 112/DIG. 2 |
| 614139 | 7/1978 | U.S.S.R. | 112/DIG. 2 |

*Primary Examiner*—Clifford D. Crowder
*Assistant Examiner*—Larry D. Worrell
*Attorney, Agent, or Firm*—Kennedy & Kennedy

[57] ABSTRACT

A hem former (16) for folding the margin of a sheet of material in preparation for sewing is mounted to the sewing bed (11) of a sewing machine (10). The hem former has a mounting plate (17), a guide plate (18) having a guide edge (23) and channels (24) extending therethrough, a support plate (22) having a front edge (28) reciprocally mounted upon the guide plate, and a guide cap (36). The guide cap has air nozzles (38) coupled to a supply of compressed air so as to generate an airstream directed beneath the front edge of the support plate and into the channels of the guide plate. The airstream urges the margin of material over the front edge of the support plate and into abutment with the guide edge.

6 Claims, 3 Drawing Sheets

HEM FORMER

TECHNICAL FIELD

This invention relates to formers and methods for folding back the margin of sheet material in preparation for sewing.

BACKGROUND OF THE INVENTION

The margin of sheet material, such as cloth, is often folded back and sewn to form a hem. The material may be manually folded back by a workers operating a sewing machine stitching the hem. However, in a commercially environment the manual folding and aligning of material is time consuming and inexact, often resulting in uneven hems or hems of different widths.

Formers have been provided which enable an operator to fold back the margin through the movement of the material through the former. Typically, these formers have plates which form a channel which progressively inverts the margin as the material is moved through the channel towards the sewing machine. However, to obtain a uniform hem these formers still rely on the operator's skill and close attention in directing the cloth through the former and in maintaining proper alignment of the material throughout sewing.

Formers have also been provided which use jets of air to urge material into a duct of the former. The duct has a guide at one end which the edge of the material abuts to maintain its alignment. This type of former is shown in U.S. Pat. No. 3,595,187. However, oftentimes the air from these jets causes the margin of the material to flutter, thus causing the margin to become misaligned.

It thus is seen that a need remains for a former for folding back the margin of a sheet of material in a more efficient and effective manner. It is to the provision of such that the present invention is primarily directed.

SUMMARY OF THE INVENTION

In a preferred form of the invention, a hem former for folding back the margin of sheet material in preparation for sewing, comprises a support plate having an upper surface and a lower surface joined to the upper surface at an elongated edge. The hem former also has a first guide means for deflecting the margin of the sheet material downward, second guide means for aligning and guiding the margin of the sheet material, the second guide means having at least one air intake orifice therethrough, and means for generating an airstream flowing beneath the support bottom surface and into the second guide means orifice. With this construction the margin of sheet material urged over the front edge of the plate is entrained into the air stream so as to be folded back into abutment with the second guide means in preparation for sewing.

DETAILED DESCRIPTION

Figure 1:
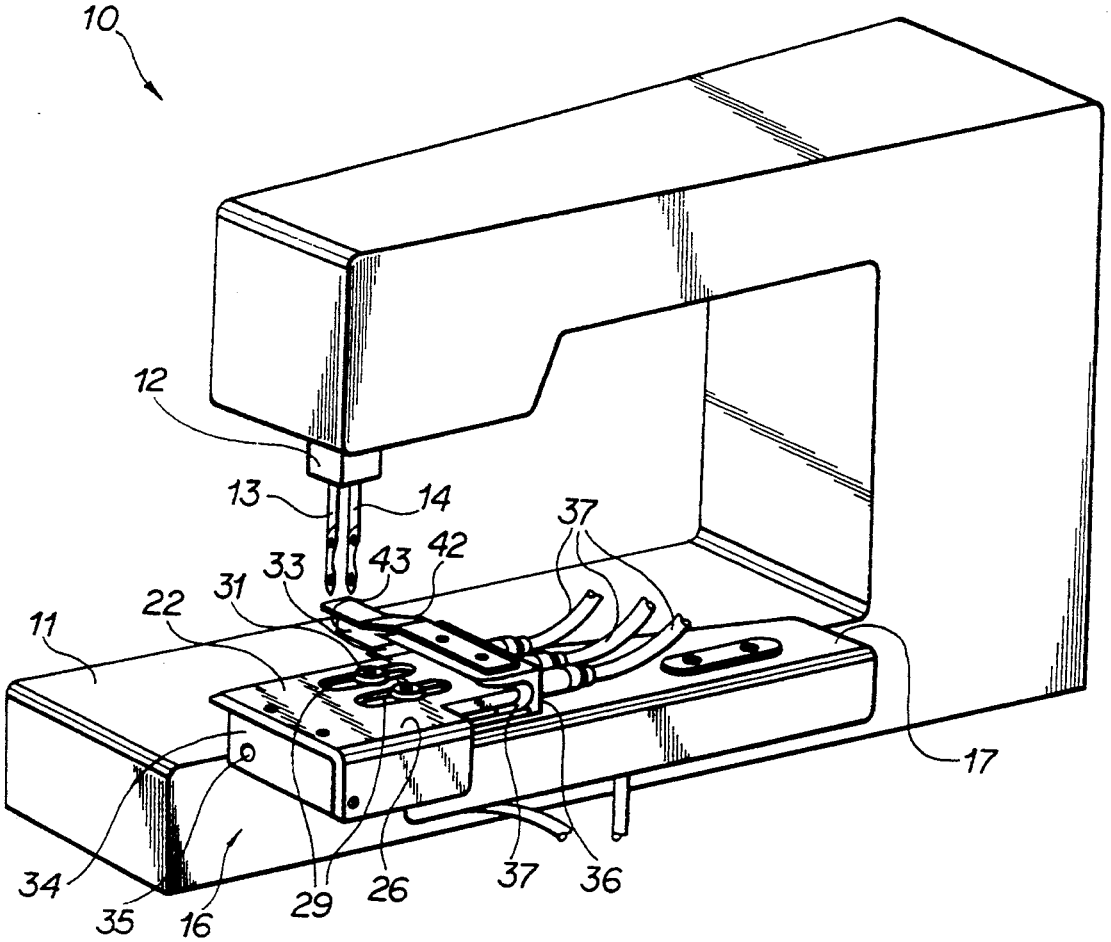
FIG. 1 is a perspective view of a conventional sewing machine to which a hem former embodying principles of the invention is mounted.
Figure 8:
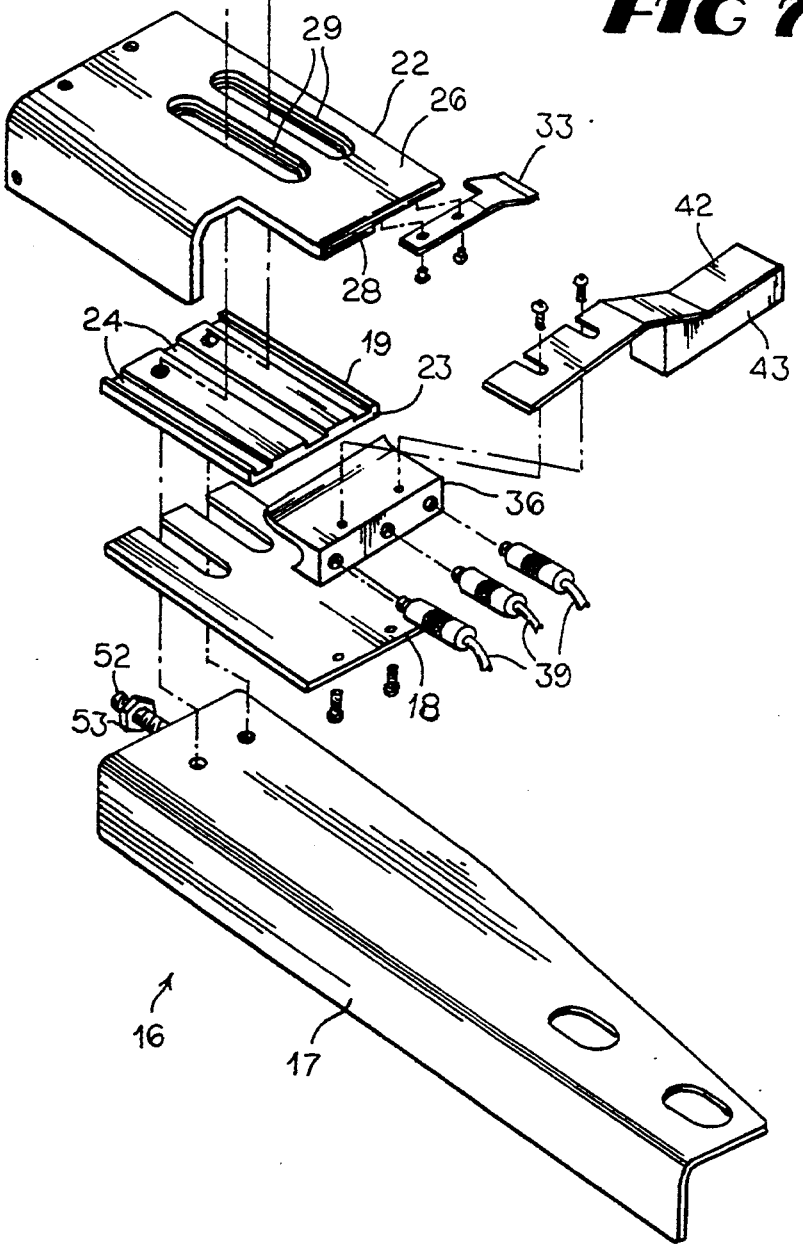
FIG. 8 is an exploded view of the hem former of FIG. 1.

With reference next to the drawing, there is shown in FIG. 1 a conventional sewing machine 10 of the type having a sewing bed 11 and a sewing head 12 having a reciprocating outside sewing needle 13 and a reciprocating inside sewing needle 14. A hem former 16 is mounted upon the sewing bed 11. The hem former 16 comprises an elongated mounting plate 17, an adjustment plate 18 mounted upon the mounting plate 17, a guide plate 19 mounted upon the adjustment plate 18, and a support plate 22 reciprocally mounted upon the guide plate 19. The guide plate 19 has a guide edge 23 and three elongated channels 24 extending therethrough from the guide edge 23. The support plate 22 has a top surface 26, a bottom surface 27, an elongated front edge 28, and two elongated, countersunk slots 29 extending completely through the support plate. Two mounting posts 31 extend through the elongated slots 29 of the support plate, through the guide plate 19, through the adjustment plate 18, and are threadably mounted to the mounting plate 17. As best shown in FIG. 8, a guide finger 33 is mounted to the underside of the support plate with a portion of the guide finger mounted along the front edge 28 of the support plate flush with the bottom surface 27 and a portion extending beyond the support plate towards the sewing needles. An end plate 34, having a threaded hole 35 extending therethrough, is mounted along the rear edge of the support plate 22.

A guide cap 36 is mounted upon the adjustment plate 18. The guide cap 36 has a U-shaped channel 37 and three laterally aligned air nozzles 38 extending therethrough. Three air line 39 are coupled to the guide cap in fluid communication with the air nozzles 38. A hem finishing cover 42, having a finishing edge guide 43 depending therefrom, is mounted upon the guide cap 36.

A pneumatic drive 46 is mounted to the underside of the mounting plate 17. The pneumatic drive 46 has a cylinder 47 having an air line 48 mounted at one end and an air line 49 mounted adjacent its other end, and a piston movably mounted within the cylinder 47. The piston has a piston rod 52 extending from an end of the cylinder opposite air line 48 which is threadably mounted within the end plate hole 35. A lock nut 53 is threadably mounted to the piston rod 52. A stop 54 having a set screw 55 is movably mounted to the piston rod. Air lines 39, 48 and 49 are connected to a source of air under pressure, such as an air compressor, and are regulated through actuation switches operable by an operator, such as a sewing machine operator.

Operation of the hem former may best be understood by reference to FIGS. 3–7. Compressed air is passed through each air line 39, at a rate of approximately 4.9 scfm, to form an airstream emanating from each air nozzle 38. Each of these airstreams is directed below the front edge 28 of the support plate, along its bottom surface 27, and into a channel 24 of the guide plate aligned with an air nozzle 38, as illustrated by the arrows depicted in FIG. 7.

Figure 4:
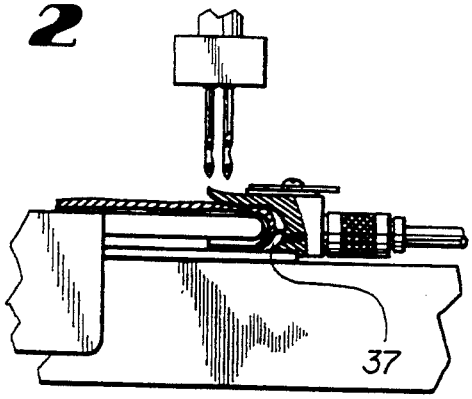
Figure 5:
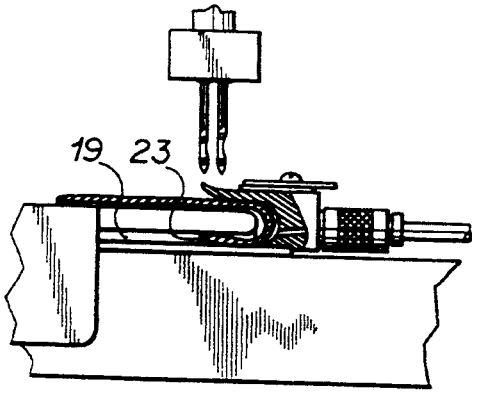

The margin of a sheet of material M is urged over the top surface 26 of the support plate and past its front edge 28. The edge of the material then drops over the front edge 28 where it is entrained into the airstream, as shown in FIG. 4. Should the material be somewhat inflexible the U-shaped channel 37 aids in turning down the margin of the material into the path of the airstreams. The margin is then urged by the airstreams into abutment with the guide edge 23 of guide plate 19, as shown in FIG. 5. The channels 24 allow the majority of the airstreams to flow smoothly through the guide edge 23, so as not to create air turbulence in the general area of the guide edge which could cause the edge of the material to flutter. Although the apparatus is shown mounted to a horizontal surface it should be understood that it obviously may also be mounted to an incline or even vertical surface. Thus, the reference to "down" herein is only for ease of explanation.

Figure 6:
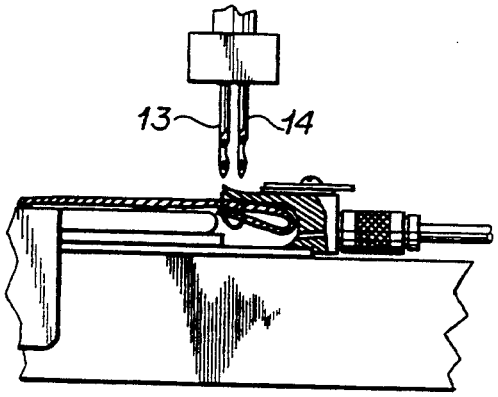
Figure 7:
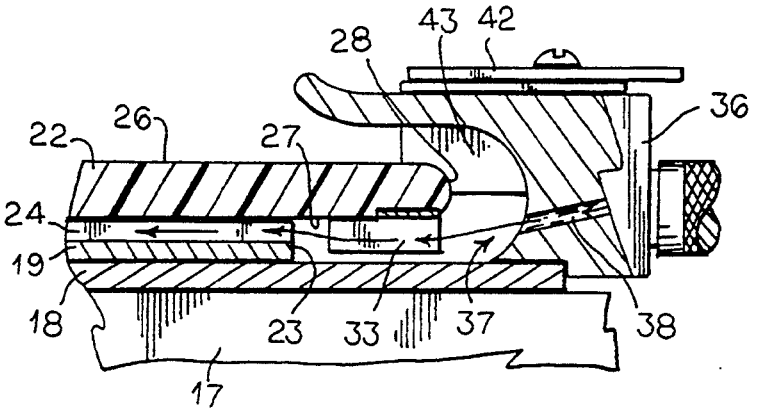
FIG. 7 is a cross-sectional view of a portion of the hem former of FIG. 1.

With actuation of the sewing machine 10 its feeding mechanism draws the material past the sewing needles 13 thereby stitching the turned down margin to the overlaying material thus completing the hem, as shown in FIG. 6. As the material is drawn laterally towards the head of the sewing machine, the air streams continually maintains the edge of the material in abutment with the guide edge 23. It should be noted that the air nozzles 38 are oriented approximately 5° downward and approximately 2° towards the sewing needles. The forward angle of the air nozzles aids in moving the material laterally through the hem former 16.

Figure 2:
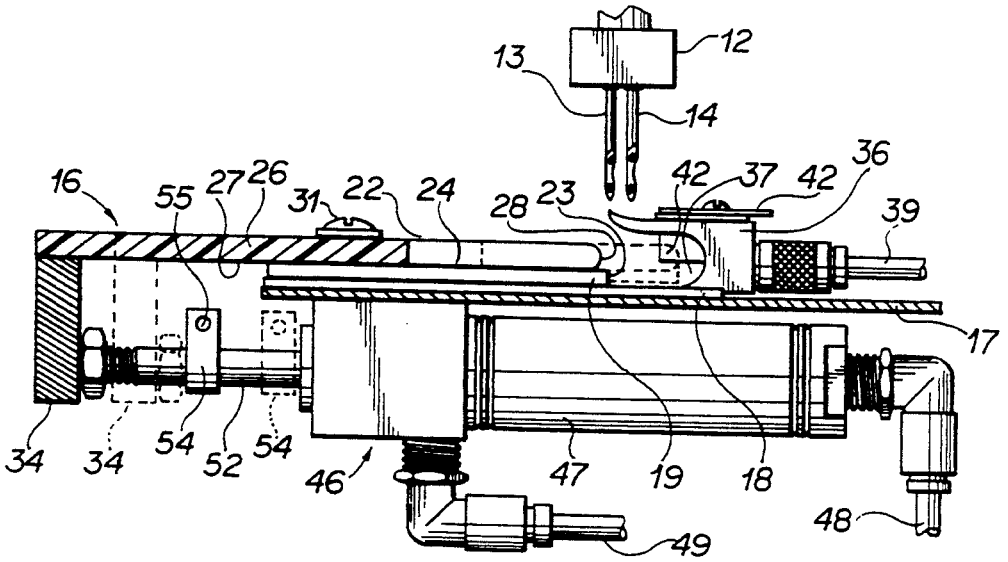
FIG. 2 is a side view of the hem former of FIG. 1 shown with a portion of a sewing head of the sewing machine and portions of the former removed for clarity.
Figure 3:
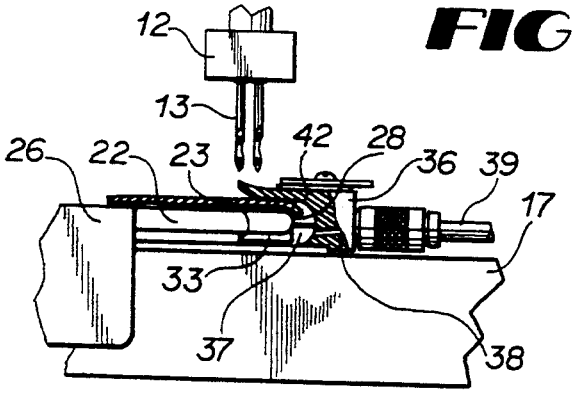
FIGS. 3–6 are a sequence of views of a portion of the hem former of FIG. 1 shown mounted to a sewing machine, which show, in sequence, a sheet of material being turned back by the hem former and sewn.

The support plate 22 may be moved to a retracted position with it front edge removed from the U-shaped channel, as shown in FIGS. 2 and 6. This allows the previously sewn portion of sheet material of a continuous loop construction, such as the bottom of a T-shirt, to pass through the former unobstructed by the support plate so it may be sewn with an overlying stitch. To do so the pneumatic drive 46 is actuated by forcing compressed air into the cylinder through air line 48 so as to drive the piston rod 52 from the cylinder. The support plate is thereby retracted to a position wherein its front edge 28 is positioned over the guide plate 19 and behind the guide edge 23 of the guide plate. This support plate position also places the guide finger 33 in lateral alignment with the outside needle 13 so that as the margin of the material leaves the guide edge 23, and is pressably held by the finishing cover 42, the edge of the material is maintained by the guide finger in proper alignment with the outside needle. The guide finger 33 is set back from the guide edge 23 of the guide plate 19 a distance sufficient to adjust for the widening of the margin as it is pressably passed beneath the finishing cover 42.

The retracted position of the support plate 22 may be adjusted by threading the piston rod 52 into the end plate hole 35. The further the piston rod is threaded into the end plate the closer the front edge 28 of the support plate is positioned to the guide edge 23. The proper position of the front edge is determined by the width of the hem since wider hems expand further than narrower hems when pressed by the finishing cover 42. Therefore, wide hems require the front edge 28 to be positioned farther behind the guide edge than narrow hems. The threaded position of the piston rod is maintained by tightening lock nut 53 against the end plate 34.

It should be noted that the just described retracted positioning of the support plate 22 is intended for the cover stitching of raw edged material. However, it should be understood that the hem former 16 may be used with other types of stitching patterns by merely adjusting the positional of the support plate relative to the sewing needle or needles.

In FIG. 2, the support plate 22 is shown in phantom lines positioned with its front edge 28 within the U-shaped channel 37 of guide cap 36 and the stop 54 abutting the cylinder 47. To enable the former to produce hems of different widths, this extreme inward position of the front edge 28 is adjustably limited by the positioning of the stop 54 along the piston rod 52. For example, to produce a wide hem the stop 54 is positioned to allow the support plate front edge 28 to extend well into the channel 37 distally from guide edge 23. Conversely, to produce a narrow hem the stop is positioned to allow the front edge to slightly overhang the guide edge 23. The support plate 22 is forced to this position by directing compressed air through air line 49 into cylinder 47, thereby forcing piston rod 52 inward.

From the foregoing, it is seen that a method and former for folding back the margin of a sheet of material is now provided which overcomes problems associated with those of the prior art. It should however be understood that the just described embodiment merely illustrates principles of the invention is a preferred form. Many modifications, additions and deletions may, of course, be made thereto without departure from the spirit and scope of the invention as set forth in the following claims.

We claim:

1. A method of folding back a margin of a sheet of material in preparation for sewing with the use of a hem former having a first guide means for deflecting the margin of the sheet of material downward, a second guide means for aligning and guiding the margin of the sheet material, the second guide means having at least one air intake orifice therethrough, a support plate movable between a first position extending beyond the second guide means and proximal the first guide means and a second position retracted behind the second guide means and distal from the first guide means, the support plate having an upper surface and a lower surface extending from the upper surface along an elongated front edge, and means for generating an airstream flowing beneath the support plate bottom surface and into the second guide means orifice, the method comprising the steps of:

(a) positioning a support plate to overhang a guide means;

(b) advancing the margin of a sheet of material over an upper surface of a support plate in a direction so as to extend beyond a front edge of the support plate;

(c) guiding the margin downward about the front edge of the support plate;

(d) introducing an airstream directed below the support plate in a direction generally opposite to the direction of sheet advancement over the upper surface and into an orifice extending through the guide means;

(e) entraining the margin of the sheet of material into the airstream so as to turned down the margin beneath the support plate into abutment with the guide means thereby folding back the margin of a sheet of material in preparation for sewing; and (f) retracting the support plate behind the guide means.

2. The method of claim 1 wherein the airstream is continually introduced throughout the sewing of the margin of material.

3. A hem former for folding back a margin of sheet material in preparation for sewing, comprising a support plate having an upper surface and a lower surface, said upper surface and said lower surface merging along an elongated front edge; first guide means mounted adjacent said elongated front edge for deflecting the margin of the sheet material downward; second guide means mounted beneath said lower surface for aligning and guiding the margin of the sheet material, said second guide means having at least one air intake orifice therethrough, said support plate mounted for reciprocal movement of said elongated front edge between a first position extending beyond said second guide means and proximal said first guide means and a second position retracted behind said second guide means and distal from said first guide means; means for moving said support plate, and means for generating an airstream flowing beneath said support bottom surface and into said second guide means orifice, whereby the margin of sheet material positioned upon the support plate in its first position is urged over the elongated front edge of the support plate and entrained into the air stream flowing from said means for generating an airstream so as to be folded back along said elongated front edge into abutment with the second guide means in preparation for sewing, and whereby the support plate is moved to its second position to complete the sewing of the margin.

4. The hem former of claim 3 wherein said first guide means comprises a block having a U-shaped channel therein.

5. The hem former of claim 3 wherein said second guide means comprises a plate having a generally flat edge through which said orifice extends.

6. The hem former of claim 3 wherein said means for generating a airstream comprises an air nozzle.

* * * * *